US005174341A

United States Patent [19]

Steiner et al.

[11] Patent Number: 5,174,341

[45] Date of Patent: Dec. 29, 1992

[54] TRAVERSING SHED LOOM WITH WARP PLACING GUIDES

[75] Inventors: Alois Steiner, Rieden; Walter Koch; Peter Grimm, both of Ruti, all of Switzerland

[73] Assignee: Sulzer Brothers Limited, Winterthur, Switzerland

[21] Appl. No.: 692,283

[22] Filed: Apr. 26, 1991

[30] Foreign Application Priority Data

May 11, 1990 [CH] Switzerland ..... 01598/90

[51] Int. Cl.[5] ..... D03D 41/00

[52] U.S. Cl. ..... 139/28; 139/11; 139/460

[58] Field of Search ..... 139/28, 460, 11

[56] References Cited

U.S. PATENT DOCUMENTS 4,290,458 9/1981 Steiner ..... 139/28
4,291,729 9/1981 Steiner ..... 139/28
4,388,951 6/1983 Atkinson et al. ..... 139/28
4,487,233 12/1984 Steiner ..... 139/28
4,498,501 2/1985 Steiner ..... 139/28

*Primary Examiner*—Andrew M. Falik
*Attorney, Agent, or Firm*—Kenyon & Kenyon

[57] ABSTRACT

The traversing shed loom has a shedding weaving rotor into which weft yarns are picked. The rotor has shedding elements and beating-up combs in which warp placing guides place warn yarns by moving transversely to the direction of rotor rotation. Most of the warp yarns are deflected transversely to the direction of rotation during shedding and the deflection is cancelled only by the shedding elements moving away before the beating-up of the weft so that the warp yarns are realigned. The beating-up combs have at least two warp yarns per occupied space. The position of guides, the geometry and position of the combs, the position of top shed guides and bottom shed guides and the warp yarn placing program are so adapted to one another that the streakiness, i.e., warp streakiness, is controllable.

11 Claims, 10 Drawing Sheets

TRAVERSING SHED LOOM WITH WARP PLACING GUIDES

This invention relates to a traversing shed loom.

As is known, traversing shed looms have been constructed of a weaving rotor having shedding elements which form weft insertion channels and beating-up combs arranged in alternating relationship with the shedding elements about the periphery of the rotor. In addition, guides for warp yarns have been offset around the periphery of the rotor by the order of magnitude of a number of comb separation angles against the direction of rotor rotation from a cloth beat-up edge. The guides are usually disposed at a reduced distance from the shedding elements and beating-up combs rotating past them and shift the warp yarns transversely of the direction of rotation, the warp yarns being programmed and co-ordinated with rotor rotation in order that the warp yarns may be placed in appropriate spaces in the combs and shedding elements.

Examples of a traversing shed loom having a weaving rotor are described in German O.S. 2 318 755, Russia Patent SU 186 898 and European Patent 0 196 349 while Russian patent SU 277 634 and European Patent 012 253 disclose shedding by guides. Guide bars are also used in curtain Raschel machines (e.g., type G 517 ORN/G) manufactured by LIBA Maschinenfabric GmbH, of D-8676 Naila. Patent specifications EP 0 111 071 and EP 0 137 071 disclose beating-up combs in traversing shed looms and the construction of such combs.

The function of warp placing guides at a traversing shed loom is described in U.S. Pat. Nos. 3,848,642, 4,290,458, and 4,487,233.

Traversing shed looms are used conventionally mainly to produce loose curtain materials and gauzes in which a warp yarn spacing is a multiple of warp yarn thickness.

The trend towards denser fabrics and closer warp yarn spacings means that fabric quality is being increasingly determined by the dimensions of the shedding elements and the guides which cannot be reduced ad infinitum, and by the cooperation between them. It is more particularly required to avoid undesirable striping of the warp, the term "striping" being understood as a systematic variation of the spacing between two adjacent warp yarns from an average spacing between warp yarns in the cloth.

Accordingly, it is an object of the invention to reduce warp striping at reduced average warp yarn spacings in cloth made on a traversing shed loom.

It is another object of the invention to produce a more homogeneous fabric than previously obtained with traversing shed looms.

Briefly, the invention provides a traversing shed loom having a weaving rotor for delivering warp yarns and weft yarns to a cloth beating-up edge, a plurality of shedding elements circumferentially spaced about the rotor to define a series of weft insertion channels and a plurality of beating-up combs circumferentially spaced about the rotor at predetermined spacings in alternating manner with the shedding elements.

Each shedding element is provided with top shed guides defining top shed ducts for receiving a plurality of warp yarns in a transversely deflected manner and bottom shed guides defining bottom shed ducts for receiving a plurality of warp yarns in transversely deflected manner.

Each comb has a plurality of teeth disposed transversely of the rotor and spaced apart to define warp-yarn receiving spaces between opposed side surfaces of adjacent teeth of a width sufficient to receive at least two warp yarns therein.

In accordance with the invention, a plurality of axially oscillating warp placing guides are disposed about the rotor at a spacing from the beating-up edge equal to an even multiple of the spacing of the combs plus a preset tensioning angle in order to produce a predetermined variation of warp yarn tension in dependence upon the tensioning angle. These warp placing guides are also radially spaced from the shedding elements and the combs for shifting the warp yarns transverse to the direction of rotation of the rotor into the corresponding ducts (spaces) between the bottom and top shed guides. The thus formed sheds are combed towards the beat-up edge for an accurate position the warp yarns are positioned transversely to the direction of rotation by a side surface of a tooth of a comb dipped between the warp yarns with the beating-up of two consecutive weft yarns.

One advantage of the traversing shed loom is that the loom can be used to produce a cloth having relatively dense warp yarn spacings without warp striping.

During beat-up, the warps in the yarn-receiving spaces of the beating-up combs which are pulled transversely together are placed by warp placing guides of smaller tensioning pull than the warps which are pulled transversely apart from each other by other warp placing guides.

These and other objects and advantages of the invention will become more apparent from the following detailed description taken in conjunction with the accompanying drawings wherein.

Figure 3A:
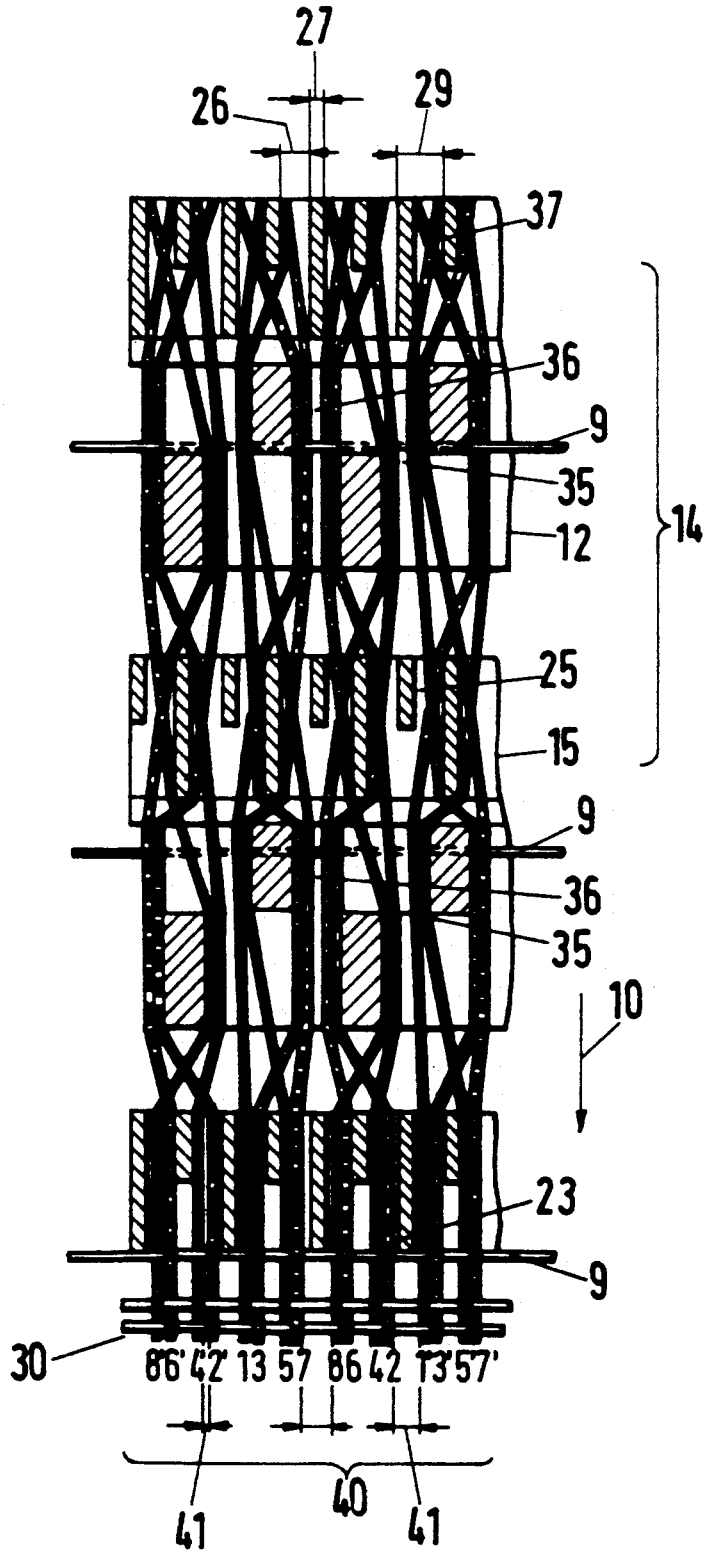
Figure 3B:
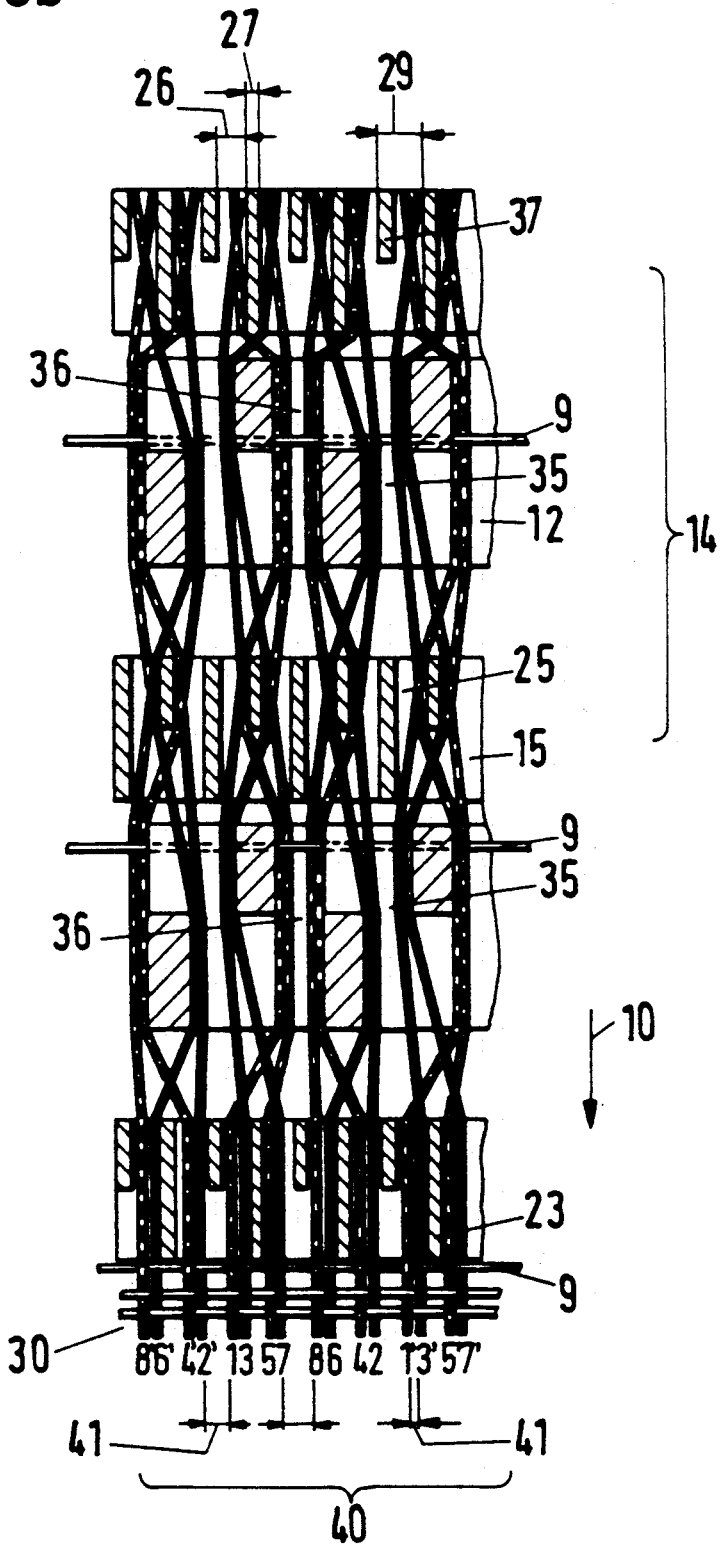
Figure 4A:
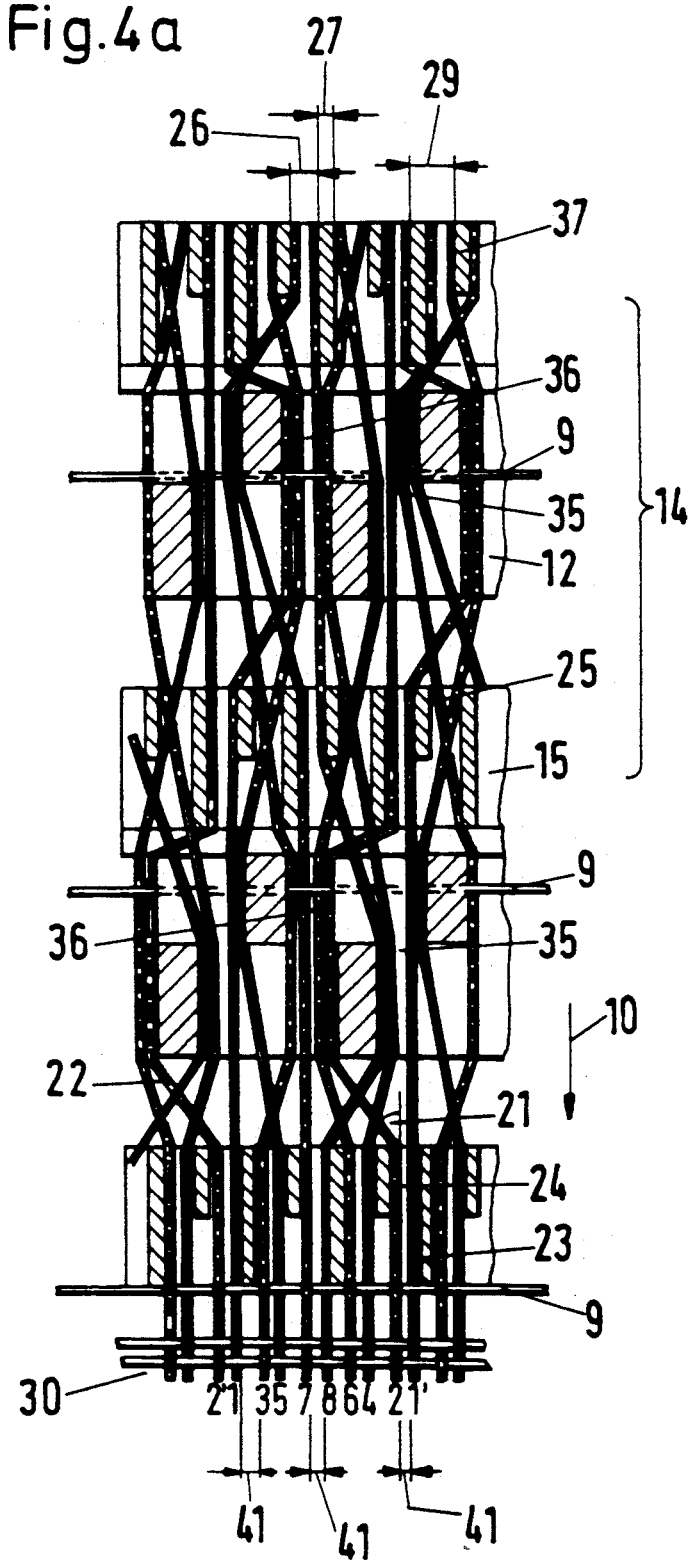
Figure 4B:
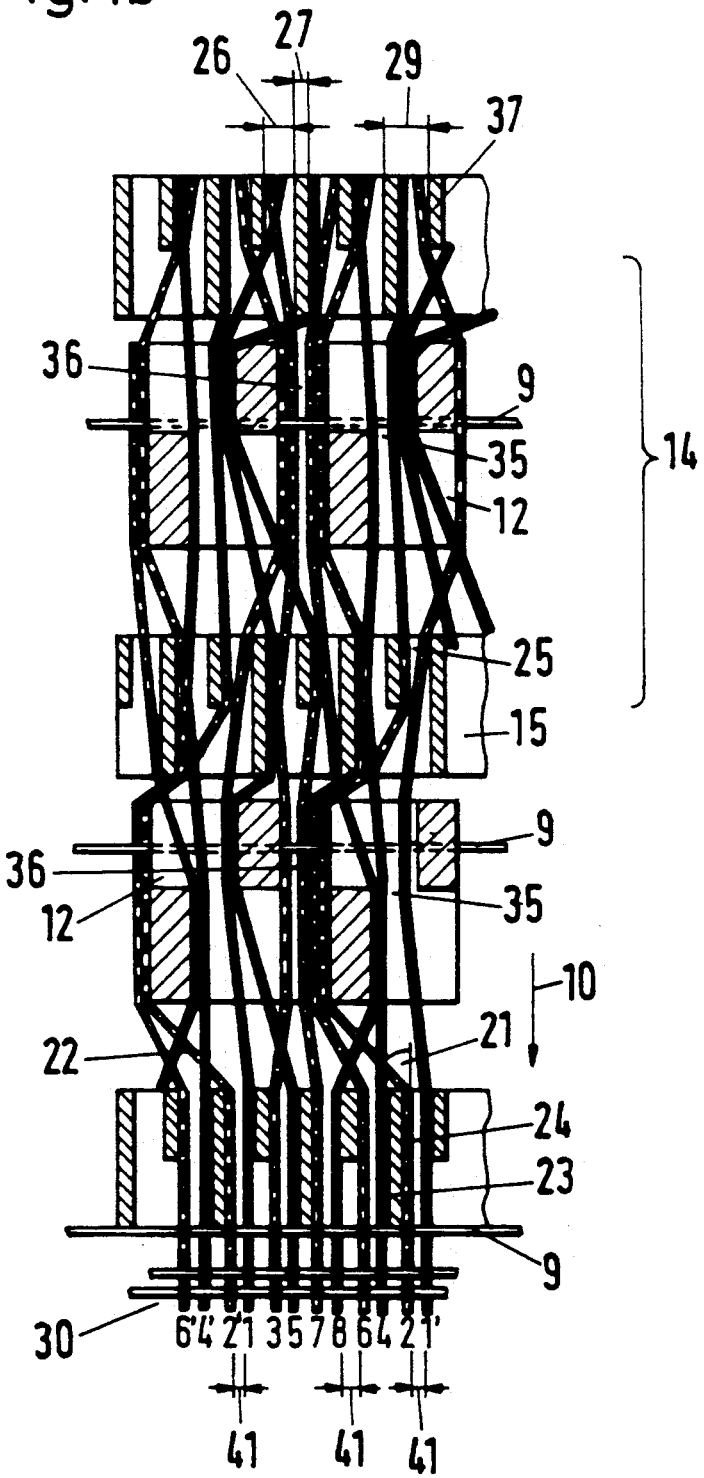
Figure 4C:
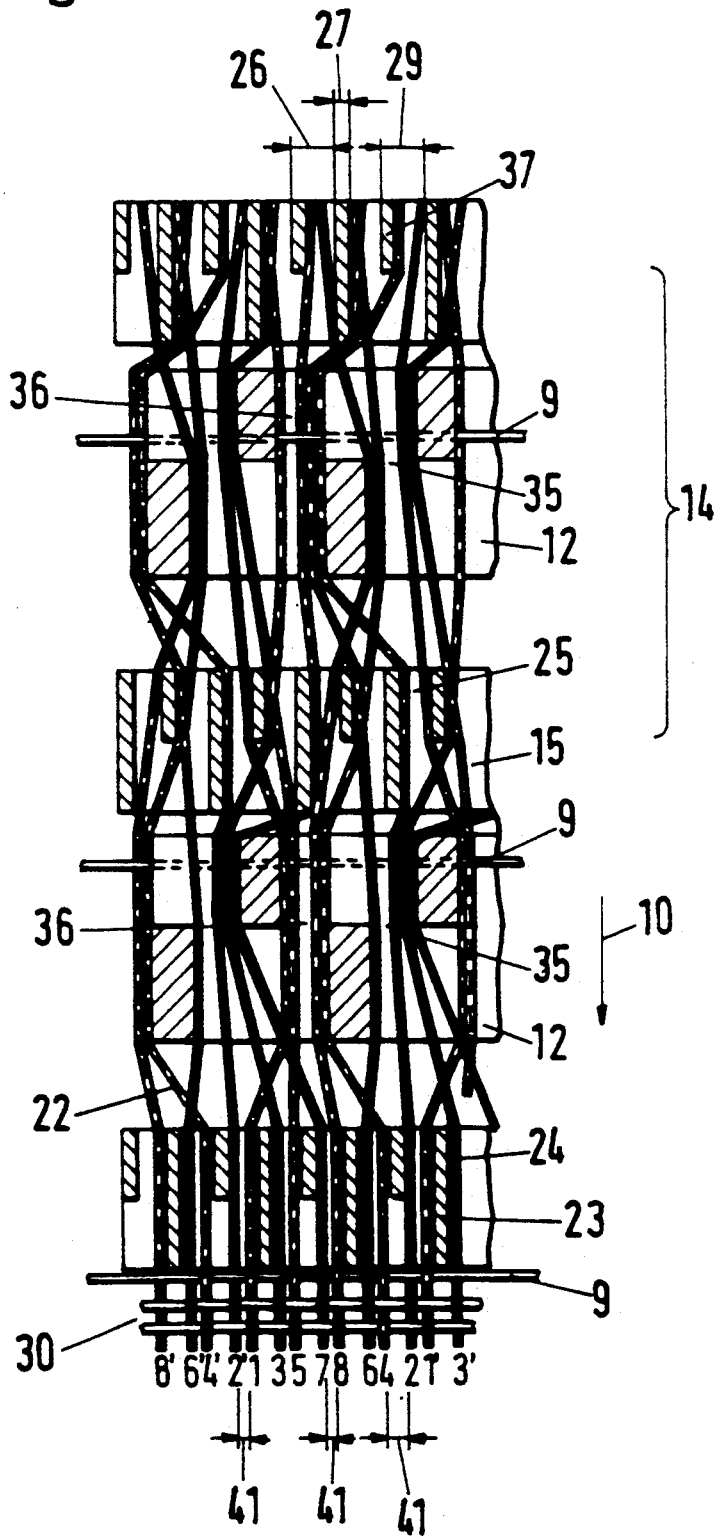
Figure 5A:
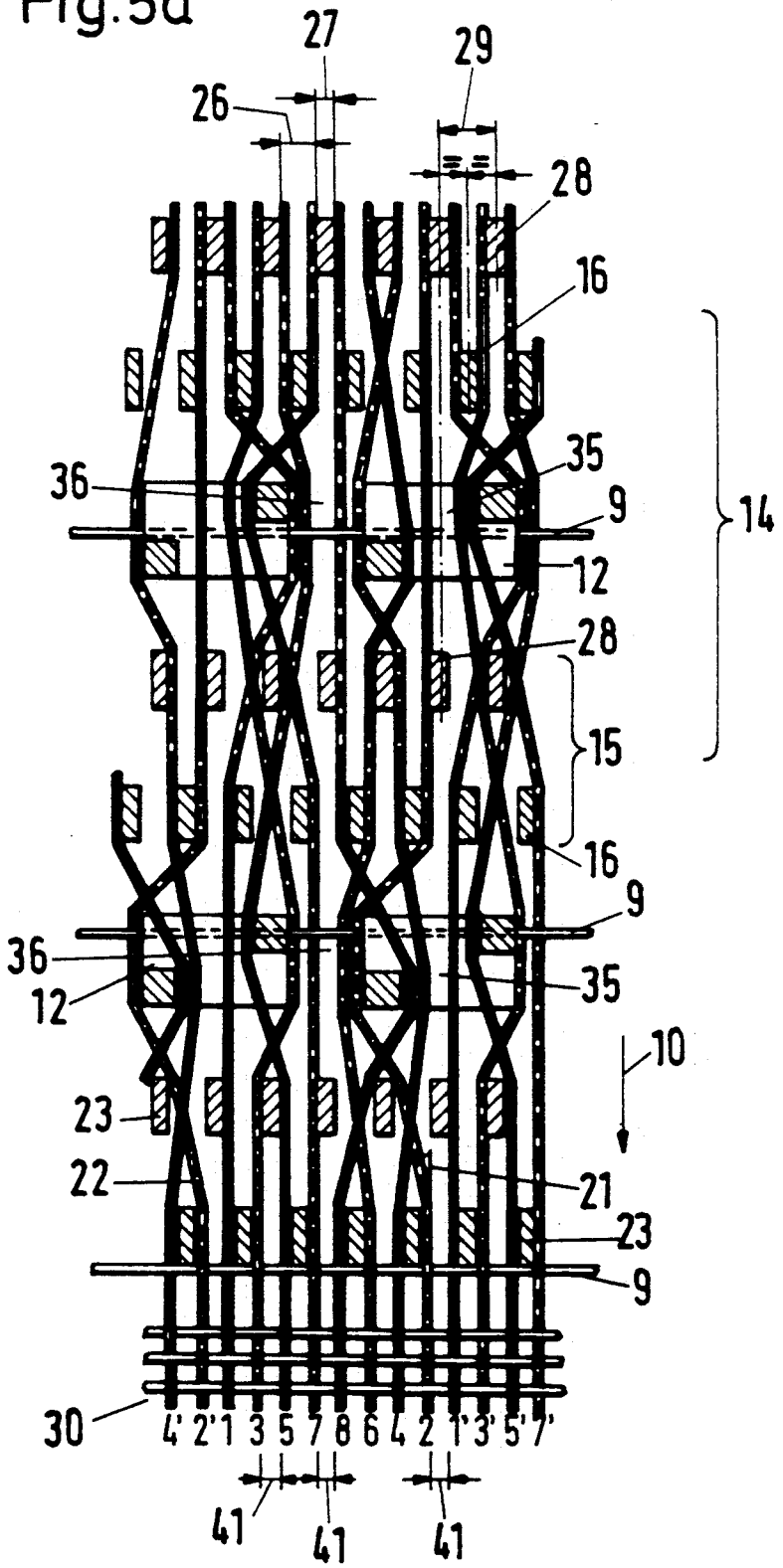
Figure 5B:
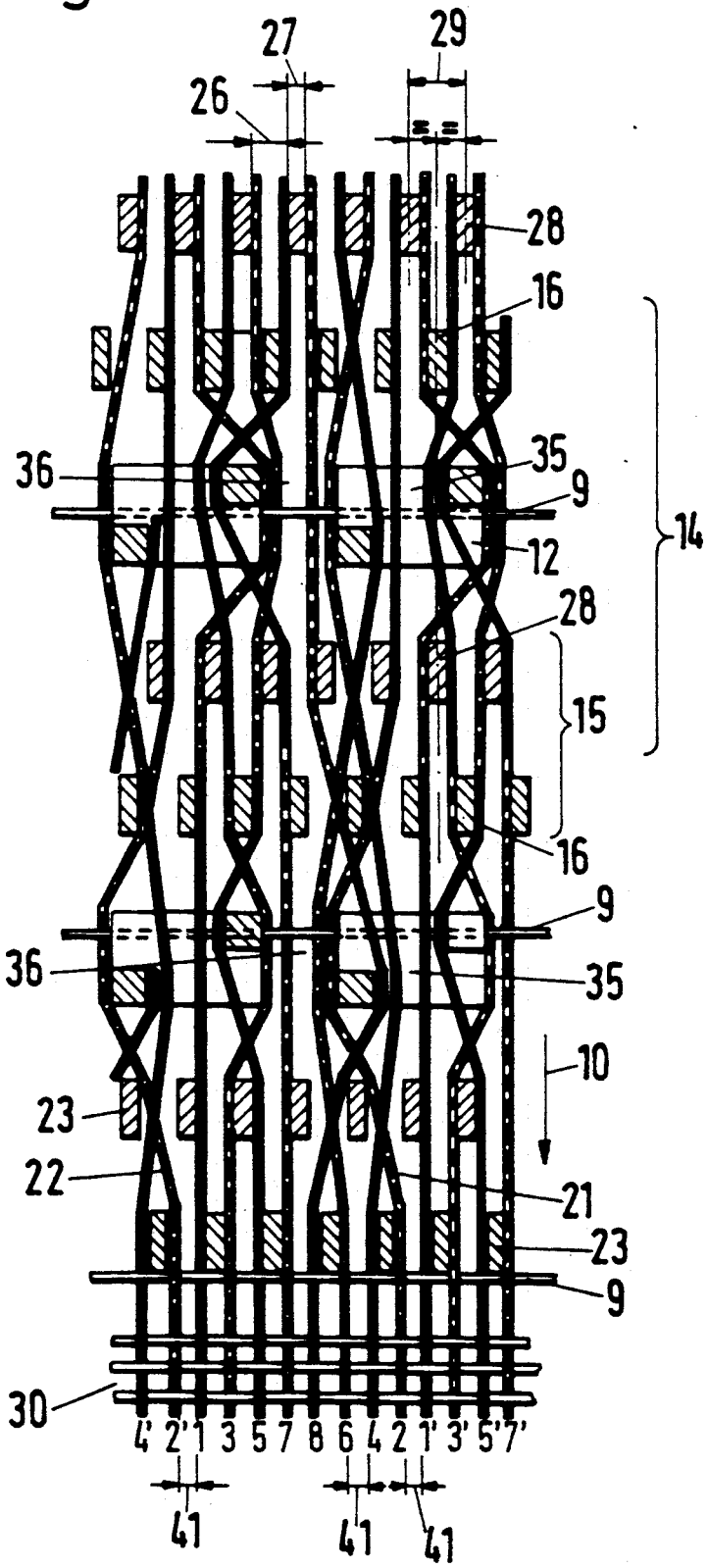
Figure 6:
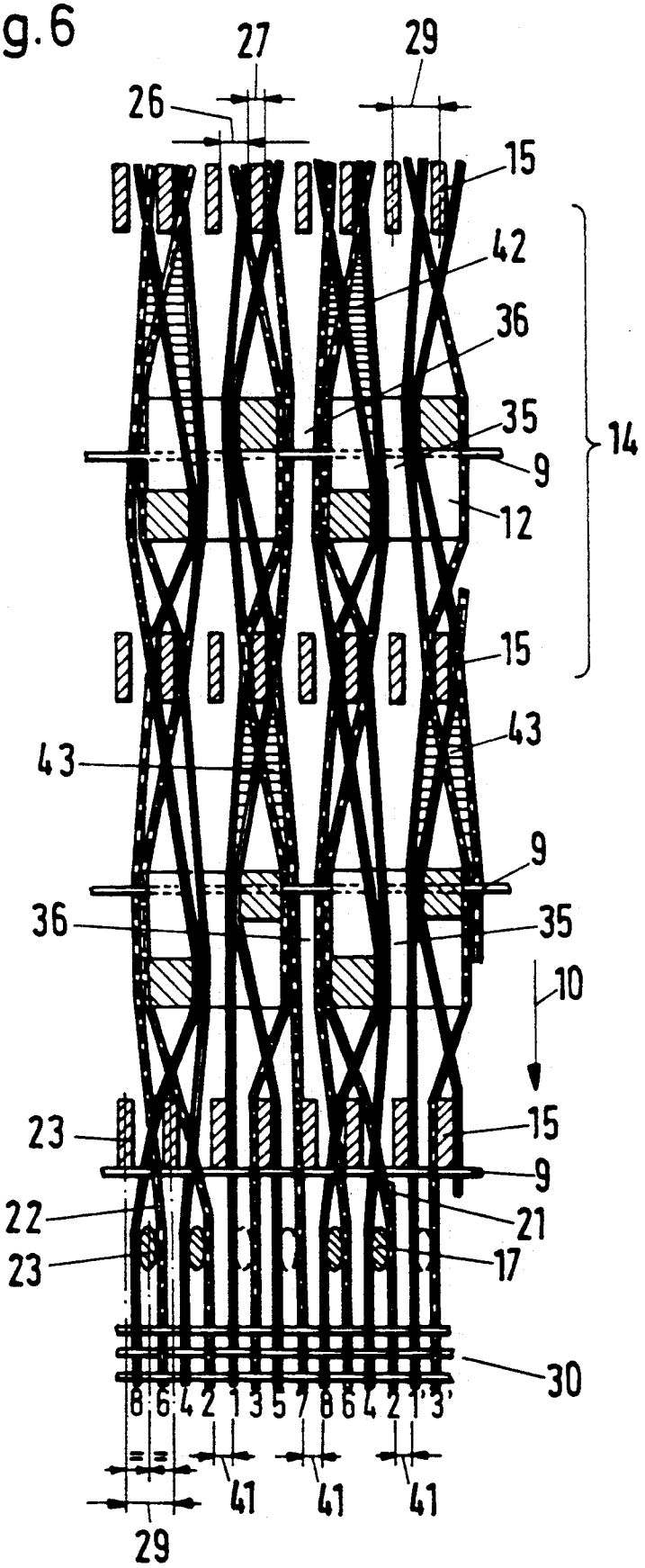

FIGS. 3*a* and 3*b* are diagrammatic and developed views showing a streaky warp yarn path on the boundary between two warp yarns groups;

FIGS. 4*a*, 4*b* and 4*c* are diagrammatic and developed views showing warp yarn paths and arrangements of beating-up combs for the placing together of the adjacent warp yarns of two warp yarn groups in beating-up;

FIG. 5*a* is a diagrammatic and developed view of a warp yarn path and an arrangement for a double beating-up comb;

FIG. 5*b* is a diagrammatic and developed view of a warp yarn path and an arrangement for double beating-up combs, consecutive main combs being offset from one another by half a comb pitch or division, and FIG. 6 is a diagrammatic and developed view of a warp yarn path in the case of a straightening comb which has dipped briefly into the warp yarns before the beating-up of the weft.

The drawings show the path of the warp yarn and the shedding associated with a weaving rotor 11 of a traversing shed loom.

Figure 1:
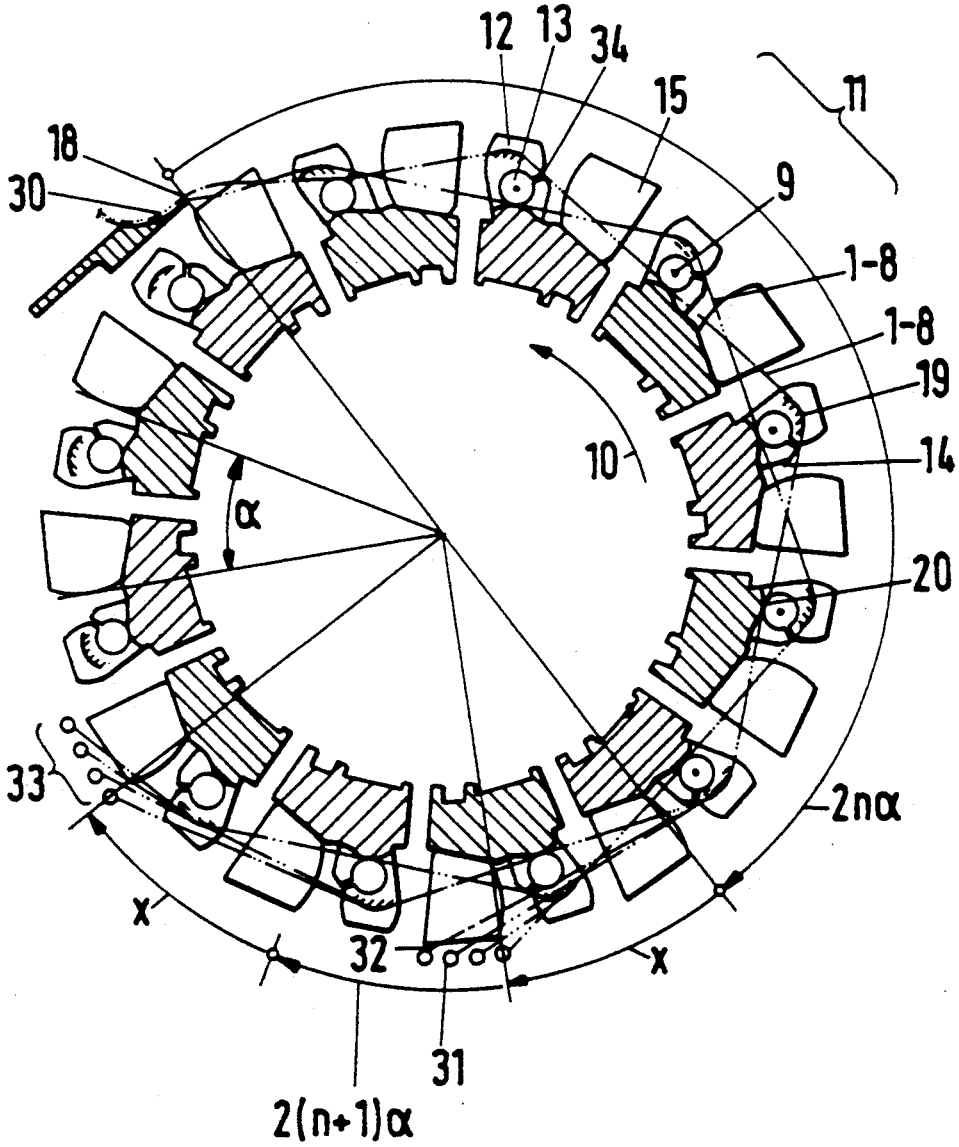
FIG. 1 is a diagrammatic section through a weaving rotor of a traversing shed loom and shows the warp yarn path from the warp placing guides to the cloth beat-up edge in accordance with the invention.

Referring to FIG. 1, the traversing shed loom has a weaving rotor 11 for delivering warp yarns and weft yarns to a cloth beating-up edge 18. As indicated, the rotor has a plurality of shedding elements 12 and beating-up combs 15 disposed in alternating relationship about the periphery. For example, twelve shedding elements 12 and twelve beating-up combs 15 are provided in equally spaced relation over a pitch or comb spacing angle $\alpha$.

The shedding elements 12 are spaced about the rotor 11 to define a series of outcuts to form insertion channels 13 for weft yarns 9. In addition, each shedding element 12 has top shed guides 19 defining top shed ducts 35 for receiving a plurality of warp yarns in a transversely deflected manner as well as bottom shed guides 20 defining bottom shed ducts 36 for receiving a plurality of warp yarns in transversely deflected manner. During operation, most of the warp yarns placed in a duct 35 or 36 are deflected transversely to the direction of rotation of the rotor 11 as indicated by the arrow 10 from the ideal beating-up position for such yarns and must be returned to the ideal position for beating-up. The distance between the top shed guides 19 and bottom shed guides 20 corresponds to the height of the shed 14 and is such as to contain the outcuts of the insertion channel 13 for a weft yarn.

Each comb 15 has a plurality of teeth 23 disposed transversely of the rotor 11 which are spaced apart to define warp-yarn receiving spaces 25 between opposed side surfaces of adjacent teeth which are of a width sufficient to receiving two warp yarns therein other than at the selvedge. As indicated in FIG. 3*a*, the internal width 26 of a space 25 corresponds to approximately twice the width 27 of a tooth 23 and the tooth pitch or division 29 corresponds to twice the ideal warp yarn pitch or division.

As indicated in FIG. 1, the comb separation or spacing angle $\alpha$, which corresponds to the spacing angle between the shedding elements 12 is, in this embodiment, one-twelfth of 360°, i.e. 30°.

So that a number of weft yarns 9 may be picked simultaneously, a number of sheds 14 are formed in which warp placing guides 31 are disposed around the periphery against the direction 10 of rotor rotation at a spacing of the order of magnitude of a number of comb spacing angles $\alpha$. The warp placing guides 31 are disposed at a spacing 32 of less than 2 millimeters (mm) from the highest points of the beating-up combs 15 and parallel to the weaving rotor axis. The warp placing guides 31 are in the form of bars or rails or the like formed with guide apertures at the spacing of the warp yarn repeat. For example, by means of one rail, the warp yarns 8, 8', 8'' and so on are placed transversely to the direction 10 of rotor rotation in programmed fashion and coordinated with rotor rotation into spaces for receiving them in the beating-up combs 15 and the shedding elements 12. The warp placing guides 31 place their warp yarns alternately in top guides 19 and bottom guides 20 (36) in order to form the sheds 14. The warp placing guides 31 also place the warp yarns in the spaces 25 in the combs 15, such spaces being intended for beating-up on the fabric.

The top guides 19 (35) and bottom guides 20 (36) which rotate past the warp placing guides 31 and the comb spaces 25 enter into the warp yarns 1–8, 1'–8' and so on delivered tangentially by the warp placing guides 31 and mesh through the warp yarns in the direction 10 until the warp yarns leave them in the direction of the beat-up edge 18. In the approach thereto, the weft yarns 9 which have meanwhile been picked are caught between the warp yarns 1–8, 1'–8' and so on and raised thereby along slots 34 from the weft insertion channel 13. Simultaneously, the guides 19 (35), 20 (36) cease to be effective for lateral guidance and enable the warp yarns to be aligned by the biasing operative between the beat-up edge 18 and the subsequent combs 15 transversely to the direction 10.

The warp yarns are secured laterally in the cloth 30 when beaten up with the weft yarn 9 presented before the beat-up comb 15. The warp streakiness of the cloth 30 reflects how successful attempts have been to align the warp yarns in a required form prior to beating-up of the weft yarns 9. The alignment becomes more difficult in proportion as more warp yarns must be combined in beating up in a comb space 25 because of lack of space.

In the case of combs 15, having at least two warp yarns per occupied space 25, the position of the warp placing guides 31, the geometry and position of the combs 15, 16, 17, 28, the position of the top shed and bottom shed guides 19, 20 and the guiding or laying program are so adapted to one another that warp streakiness or striping is controllable.

Figure 2:
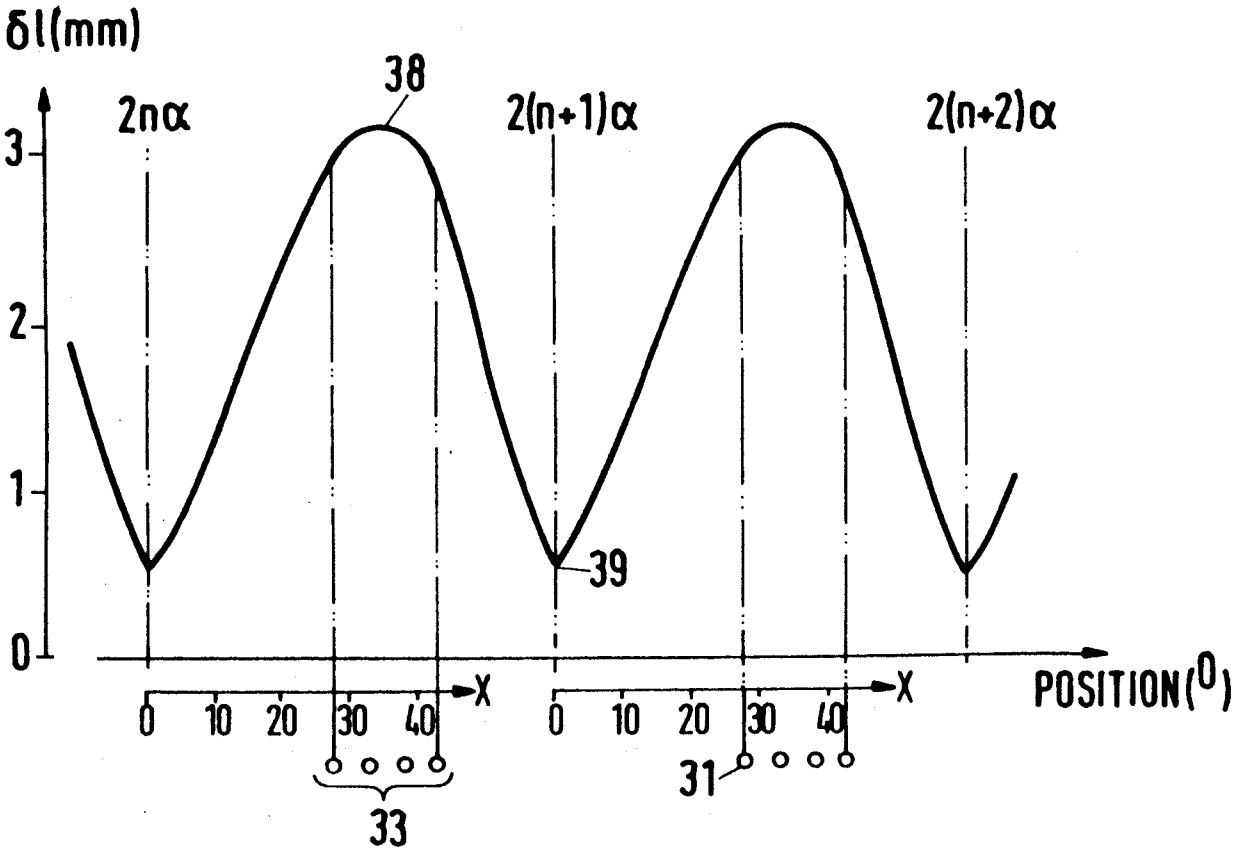
FIG. 2 is a graph in which variations in warp yarn tension are plotted against the laying-in place of the warp yarn on the periphery of a weaving rotor.

Referring to FIG. 2, variations in the pull $\delta 1$ on the warp yarn in millimeters are plotted against the change of the position of warp placement by a warp placing guide 31 along the periphery of a weaving rotor. When warp yarns are paid off a warp beam, variations in this pull during shed formation cause variations in warp yarn tension. It is interesting to note that for a weaving rotor the curve representing the pull repeats at an interval corresponding to twice the comb spacing angle $\alpha$. A first warp placing guide 31 and a second warp placing guide 33 offset from the first warp placing guide 31 by an angle $2\alpha$ around the rotor periphery have the same effect on variations in pull and therefore on the tensions in the warp yarn caused mainly by the variation in the number of the top guides 19 and bottom guides 20 operative for such warp yarn. The place where the warp placing guide 31 is mounted is defined by an even multiple of the comb spacing angle $\alpha$ plus a tensioning angle x, corresponding to an angular separation $2N\alpha+x$, from the beat-up edge 18. This position determines not only the tension variations $\delta\sigma=f(\delta|)$ in dependence upon maximum and minimum warp yarn pull but also the tensioning timing during the realignment of the warp yarns with effect from lateral release by the guides 19, 20 until beating-up of the weft 9 by a following comb 15.

A required tension pattern is produced in the warp yarn by the angular spacing $2N\alpha+x$ of the warp placing guide 31 in order to align the warp yarns during the beating-up movement. The warp placing guides 31, 33 are disposed in staggered relationship in groups 33 very close to the rotor periphery in order to produce similar tension patterns in the warp yarns during beating-up. The warp placing guides 31 can correspondingly be disposed between a maximum variation 38 of warp yarn pull $\delta|$ and a minimum variation 39 of yarn pull $\delta|$ as indicated in FIG. 2.

Also, the choice of the operating program for the warp placing guides 31 and the position of spaces 25 and teeth 23 on combs 15–17, 28 which have dipped into the warp ensure that the warp yarns are aligned by an appropriate diagonal pull 22 towards the side surfaces 24 of a comb before beating-up. In this way, FIGS. 3*a*, 3*b*, 4*a*, 4*b*, 4*c* show more "striping" than FIGS. 5*a*, 5*b* where the operating program for the warp placing guides 31 and the geometry of the combs are optimized so that during beat-up none of the two warps within a space 25 has a pull in the wrong diagonal direction behind the beat-up comb; a pull which would move it transversely towards the other warp.

Nevertheless, the influence of a pull in the wrong diagonal direction can be reduced with a suitable position of the corresponding warp placing guide 31.

The number of warp yarns placed in a top shed duct 35 and bottom shed duct 36 determine the warp yarn placing repeat. With four warp yarns per duct 35 and per duct 36, the placing pattern repeats in an eight pitch of the warp yarns transversely to the direction 10 of rotor rotation and, in the same direction, at an angular spacing of two comb spacing angles $\alpha$.

FIGS. 3 and 6 show typical placing diagrams whose differences will be described hereinafter. The illustration corresponds to a diagrammatic development of the rotor 11, intervals between combs 15 and shedding elements 13 being greatly foreshortened. Warp yarns near a top shed duct 35 in the top shed are shown in solid lines and warp yarns near a bottom shed duct 36 are shown as chain lines.

FIG. 3*a* shows combs 15 whose teeth 23 and spaces 24 are in alignment with one another in the direction 10 of rotor rotation, teeth 23 alternating with short-profile teeth 37 in and transversely to the direction of rotation 10. This feature provides space advantages in the placing of the warp yarns. Along a comb 15, every other tooth 23, 37 is in alignment with the center-line of a top shed duct 35 or a bottom shed duct 36. The internal width 26 of the spaces 25 corresponds approximately to twice the width 27 of a tooth 23, 37. The comb pitch 29 transversely to the direction of rotation 10 corresponds to twice the ideal warp yarn spacing. The spacing 41 between two adjacent warp yarns varies relatively considerably in beating-up. Excessively wide lanes occur particularly between the warp yarns 2' and 1 and between the warp yarns 7 and 8. The situation in FIG. 3*b* is similar and differs from FIG. 3*a* only by a yarn placing pattern varying by one weft beat-up.

Referring to FIGS. 4*a*, 4*b* and 4*c*, the warp yarns which are adjacent one another in the fabric 30 and which do not cross one another during placing have been placed in the same space 25 of a beating-up comb 15, the pattern of FIG. 4*c* differing by one weft beat-up from the pattern of FIG. 4*b*. Also, care has been taken to ensure together with the placing pattern that in the event of a strong inclined pull 22 after the beating-up comb 15, a warp yarn is deflected to the side boundary and not to the center of the space 25 of the latter comb 15. It should be borne in mind that the force component effective transversely to the direction of rotation 10 depends both upon the angle 21 of inclination (see FIG. 4*a*) and upon the instantaneous yarn pull—i.e., upon the position of its warp placing guide 31. In FIG. 4*a*, the center-lines of the spaces 25 of a comb 15, and not the center-lines of the teeth 23, are in alignment with the center-lines of the ducts 35, 36. In the beating-up shown, for example, the warp yarns 3 and 5 experience only a reduced pull towards the center of their space 25 since the same is in alignment with the next lateral guide between the guides 35 and 36 and keeps the angle 21 small, the remaining warp yarns experiencing no inclined pull towards the center of the space.

For a very accurate and rapid placing movement of the warp placing guides 31, the comb 15 can be embodied as a double comb in the manner shown in FIGS. 5*a* and 5*b*. The double comb is embodied in this case by an auxiliary comb 28 preceded in the direction of rotation 10 by a main comb 16. The pitch 29 of the two combs 28, 16 is the same but with a lateral offset of half a pitch 29 so that those warp yarns framing a tooth 23 of the main comb 16 are disposed together in the next registering space 25 of the following auxiliary comb 28. In FIG. 5*a*, the main combs 16 register with one another in the direction of rotation 10 whereas in FIG. 5*b*, every other main comb 16 is offset laterally by half a pitch or division, 29.

FIG. 6 shows a straightening comb 17 mounted as an individual comb outside the rotor 11. At every other beat-up, the comb 17 dips briefly before the comb 15 and weft yarn 9 into dip zones 42 between the warp yarns in order to assist the same in their alignment. Two teeth 23 are disposed one beside another at the spacing of one comb pitch or division 29 and are spaced three comb divisions apart from the next two teeth 23 in order to dip into the pattern of repeating dip zones 42. Dip zones 43 offset laterally by two comb divisions are offset by one weft beat-up from the dip zones 42 in the direction opposite to the direction of rotation 10. The zones 43 can be contrived either by a second straightening comb, whose teeth 23 are offset laterally by two comb divisions from the first straightening comb, or by the first straightening comb when the same while not dipping makes the lateral additional movement of two comb divisions 29. To increase aiming accuracy the teeth of the comb 17 are conically convergent.

The dipping movement of the combs 17 can include components of movement in the direction of rotation 10 in order to separate the warp yarns in clearly defined dip zones 42, 43 and to produce a straightening effect very close to the beating-up comb 15. Another possibility is for the teeth 23 of a straightening comb 17 to dip into the tracks of the teeth 23 after a beating-up comb 15, warp yarns being deliberately shifted more towards the center of the space as conically convergent teeth dip into them than they are by the lateral surfaces 24 of beating-up teeth 23.

The invention thus provides a traversing shed loom which is able to achieve a reduced warp striping at reduced average warp yarn spacings. Further, the traversing shed loom is able to produce a more homogeneous fabric than previously obtained on traversing shed looms.

What is claimed is:

1. A traversing shed loom comprising a weaving rotor for delivering warp yarns and weft yarns to a cloth beating-up edge;

a plurality of shedding elements circumferentially spaced about said rotor to define a series of weft insertion channels; each said shedding element having top shed guides and defining top shed ducts for receiving a plurality of warp yarns in a transversely deflected manner and bottom shed guides defining bottom shed ducts for receiving a plurality of warp yarns in transversely deflected manner;

a plurality of beating-up combs circumferentially spaced about said rotor at a predetermined spacing in alternating manner with said shedding elements, each said comb and spaced apart to define warp-yarn receiving spaces between opposed side surfaces of adjacent teeth of a width sufficient to receive at least two warp yarns therein; and a plurality of warp placing guides disposed about said rotor at a spacing from said beating-up edge equal to an even multiple of said spacing of said combs plus a preset warp yarn tensioning angle to produce a predetermined variation of warp yarn tension in dependence upon said tensioning angle, said warp placing guides being radially spaced from said shedding elements and said combs for shifting warp yarns transverse to a direction of rotation of said rotor whereby at the beat-up edge the warp yarns are positioned transversely to said direction of rotation by a diagonal pull towards a side surface of a tooth of a respective comb dipped between the warp yarns with the beating-up of two consecutive weft yarns.

2. A traversing shed loom as set forth in claim 1 wherein said warp placing guides are arranged in groups in zones of said tensioning angle where warp yarn pull variations in a group are similar.

3. A loom as set forth in claim 2 wherein said warp placing guides are offset from one another by even multiples of said comb spacing to produce equal variations of pull on of the respective warp yarns.

4. A loom as set forth in claim 1 wherein each said yarn-receiving space has an internal width approximately twice the width of a comb tooth.

5. A loom as set forth in claim 4, further comprising a first plurality of low tensioning pull warp placing guides and a second plurality of high tensioning pull warp placing guides, each said low tensioning pull warp placing guide having a preset tensioning angle for imparting a tensioning pull which is less than that imparted by each high tensioning pull warp placing guide and wherein, during beat-up, warps which cross each other transversely in said yarn-receiving spaces of said beating up combs, are placed by said low tensioning pull warp placing guides.

6. A loom as set forth in claim 1 wherein each comb is a double comb comprising an auxiliary comb and a main comb having the same tooth pitch as said auxiliary comb, said main comb having an offset of half a pitch transversely to said direction of rotation relative to said auxiliary comb and being framed during laying-in by those warp yarns which are disposed in a common space in the following auxiliary comb.

7. A loom as set forth in claim 6 wherein consecutive main combs are offset from one another by half a pitch transverse to said direction of rotation.

8. A loom as set forth in claim 1 further comprising a first straightening comb mounted outside said rotor and having a plurality of teeth for dipping briefly between the warp yarns to straighten the warp yarns.

9. A loom as set forth in claim 8 wherein said straightening comb has any two adjacent teeth spaced apart by one comb pitch, a gap of three such pitches being present between said two teeth and next two teeth, and the teeth leave out every other weft yarn to be able to dip briefly into repeating dip zones of those warp yarns.

10. A loom as set forth in claim 8 which further comprises a second straightening comb with teeth offset transversely to said direction of rotation by two comb pitches from said teeth of said first straightening comb to dip briefly into repeating dip zones in the case of second weft yarns let out from said first straightening comb.

11. A loom as set forth in claim 10 wherein said second straightening comb is offset transversely by two comb divisions and dips briefly into dip zones between the warp yarns.

* * * * *

UNITED STATES PATENT AND TRADEMARK OFFICE

CERTIFICATE OF CORRECTION

PATENT NO. : 5,174,341

DATED : December 29, 1992

INVENTOR(S) : Alois Steiner et. al.

It is certified that error appears in the above-indentified patent and that said Letters Patent is hereby corrected as shown below:

Title page, item [57]:

ABSTRACT, line 4, change "warn" to --warp--.

Column 2, line 18, change "accurate position the" to --accurate position. The--.

Column 6, line 60, change "comb and spaced" to --comb being spaced--.

Column 7, line 18, delete "on".

Signed and Sealed this

Twenty-second Day of November, 199

*Attest:*

*Attesting Officer*

Bruce Lehman

BRUCE LEHMAN

*Commissioner of Patents and Trademarks*